US006600451B2

(12) United States Patent
Mimura et al.

(10) Patent No.: US 6,600,451 B2
(45) Date of Patent: Jul. 29, 2003

(54) RING RESONATOR AND ANTENNA

(75) Inventors: Masahiro Mimura, Tokyo (JP); Mitsuo Makimoto, Kanagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/017,305

(22) Filed: Dec. 12, 2001

(65) Prior Publication Data

US 2002/0089461 A1 Jul. 11, 2002

(30) Foreign Application Priority Data

Dec. 12, 2000 (JP) ..... 2000-377004

(51) Int. Cl.[7] ..... H01Q 11/12

(52) U.S. Cl. ..... 343/741; 343/742; 343/744; 343/866

(58) Field of Search ..... 343/741, 742, 343/743, 744, 748, 788, 866, 867; H01Q 11/12

(56) References Cited

U.S. PATENT DOCUMENTS 5,734,353 A * 3/1998 Van Voorhies ..... 343/742
6,204,821 B1 * 3/2001 Van Voorhies ..... 343/742
6,259,413 B1 * 7/2001 Schmidt et al. ..... 343/742

* cited by examiner

*Primary Examiner*—Tho Phan
(74) *Attorney, Agent, or Firm*—RatnerPrestia

(57) ABSTRACT

Two conducting lines are arranged in a ring form in a TEM-mode transmission line. The end of one of the lines is connected to the end of the other line with opposite polarity, thus forming a resonator for resonation in a half-wavelength mode. This structure, free of line discontinuity which lowers the Q value, can provide a resonator having a high Q value equivalent to that of the one-wavelength resonator. Moreover, it is satisfactory to provide a half of a length of the one-wavelength resonator. Accordingly, the structure of the resonator has reduced size but little Q-value deterioration.

12 Claims, 14 Drawing Sheets

100
101
102
101
102
103
104
b
Vb
d
a
Va
d

Prior Art

RING RESONATOR AND ANTENNA

FIELD OF THE INVENTION

The present invention relates to a high-frequency ring resonator for use in a radio communication apparatus and a ring antenna.

BACKGROUND OF THE INVENTION

A radio communication apparatus is advantageous in that it can be easily configured as a communication apparatus excellent in portability, as compared to a wire communication apparatus. This apparatus in many cases requires size-reduction in order to enhance carryability. Consequently, size reduction is required also for the elements constituting the apparatus.

The small resonator, for use in high-frequency filters, oscillators or the like, often utilizes a TEM-mode one-wavelength ring resonator as shown in FIG. 1.

The upper conductor 101 and the lower conductor 102 are structured on the opposite surfaces of a dielectric substrate 100, thereby constituting a one-wavelength ring resonator. An input signal is applied through a coupling capacitor 103 to point a on the upper conductor 101. A resonant signal is outputted from point b where the electrical length corresponds to the half wavelength at the resonant frequency, and passes through the coupling capacitor 104, thus configuring a high-Q resonator.

The resonator, because an upper conductor 101, coupling capacitors 103, 104, etc. can be formed on a dielectric substrate 100 by a print or photo-etching technique, is well suited for mass production and has good reproducibility of desired characteristics.

In order to reduce the size of the one-wavelength resonator, there is a proposal that a gap is provided in the upper conductor 101 as a resonant line, a capacitance is connected in the gap, and a transmission line is coupled to the resonator, thereby extracting an output. This configuration can decrease the resonant-circuit resonant line length down to one wavelength or smaller, hence allowing for making a miniature resonator structure. However, the Q-value of the resonator might decrease due to lumped constant elements in the resonant circuit. Thus, this resonator tends to suffer deterioration in Q-value, more so than the one-wavelength ring resonator.

Meanwhile, a ring antenna is well known as an antenna for use in an RF apparatus. FIG. 2 shows a conventional structure of a ring antenna. The conductor 1101, being a balanced circuit having an electrical length corresponding to one wavelength at the resonant frequency, is connected at its end with a balun 1102. Output is generated from the unbalanced circuit of the balun 1102.

The ring antenna, simple in structure, is well suited for mass production and has good reproducibility of desired characteristics.

However, the ring antenna, on the principle, requires a line length corresponding to one wavelength. This increases the size particularly in a frequency band having a long wavelength, resulting in difficulty in manufacturing a portable radio frequency apparatus.

SUMMARY OF THE INVENTION

It is a first object of the resent invention to reduce the size of the resonator without encountering deterioration in Q-value.

A second object is to reduce the size of the ring antenna structure.

According to the present invention, when the transmission line in a TEM mode is structured by two conductors, the ends of these line are connected with opposite polarity to the ends of the other line, thereby constituting a resonator resonating in a half-wavelength mode. This structure, free of line discontinuity to deteriorate the Q value, can constitute a resonator having a high Q-value equivalent to that of the one-wavelength resonator. Moreover, the transmission line length is satisfactorily a half of that of the one-wavelength resonator. Accordingly, it is possible to miniaturize the form with a structure that has little Q-value deterioration.

Meanwhile, because there is no line discontinuity deteriorating characteristics, an antenna can be structured high in efficiency equivalent to the one-wavelength ring antenna. Accordingly, it is possible to reduce the size down to half that of the conventional antenna.

Furthermore, size reduction is further possible by inserting a capacitance element in the ring antenna circuit.

BRIEF DESCRIPTION OF THE DRAWINGS

FIG. 11 is a schematic view showing the concrete structure of the upper conductor, lower conductor and capacitance element of the ring antenna of FIG. 10, wherein

FIG. 14 is a schematic view showing the concrete structure of the upper conductor, lower conductor and capacitance element of the ring antenna of FIG. 13, wherein

DESCRIPTION OF THE EXEMPLARY EMBODIMENT

Exemplary embodiments of the present invention are demonstrated hereinafter with reference to the accompanying drawings.

1. First Exemplary Embodiment

Figure 3:
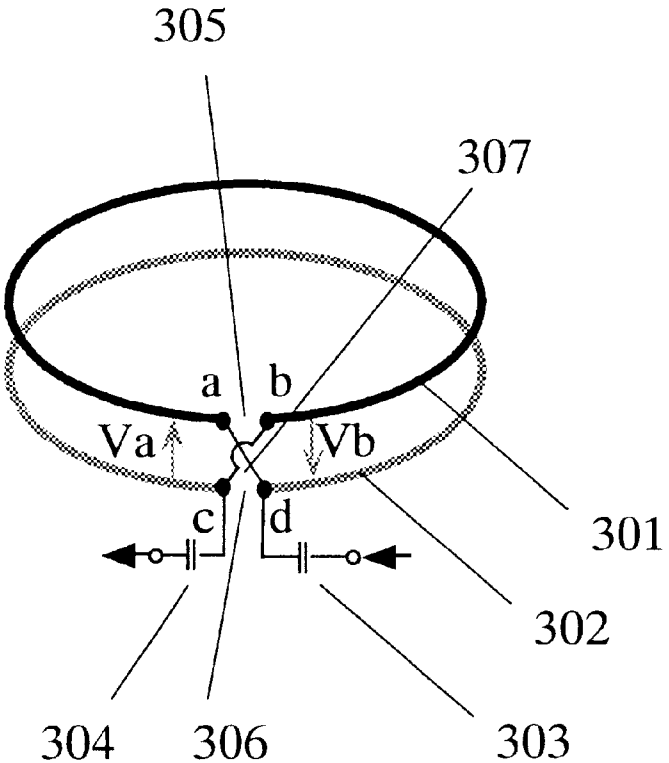
FIG. 3 is a schematic view in an embodiment of a ring resonator of the invention.

FIG. 3 shows one example of a ring resonator according to the invention. An upper conductor 301 and a lower conductor 302 are formed in tandem on the opposite surfaces of a dielectric substrate (not shown) thereby constituting a transmission line. The upper conductor 301 and the lower conductor 302 are generally formed by metal lines in a ring form etched on the dielectric substrate, to have gaps 305, 306 each formed in parts of the metal lines. Connections are made between the end a at the gap 305 of the upper conductor 301 and the end d at the gap 306 of the lower conductor 302 as well as between an end b at the gap 305 of the upper conductor 301 and an end-c at the gap 306 of the lower conductor 302, through via-holes 307 or the like. A coupling capacitor 303 to input signals is connected to the end d at the gap 306 of the lower conductor 302, while a coupling capacitor 304 is connected to the end-c to extract resonant signals.

Figure 1:
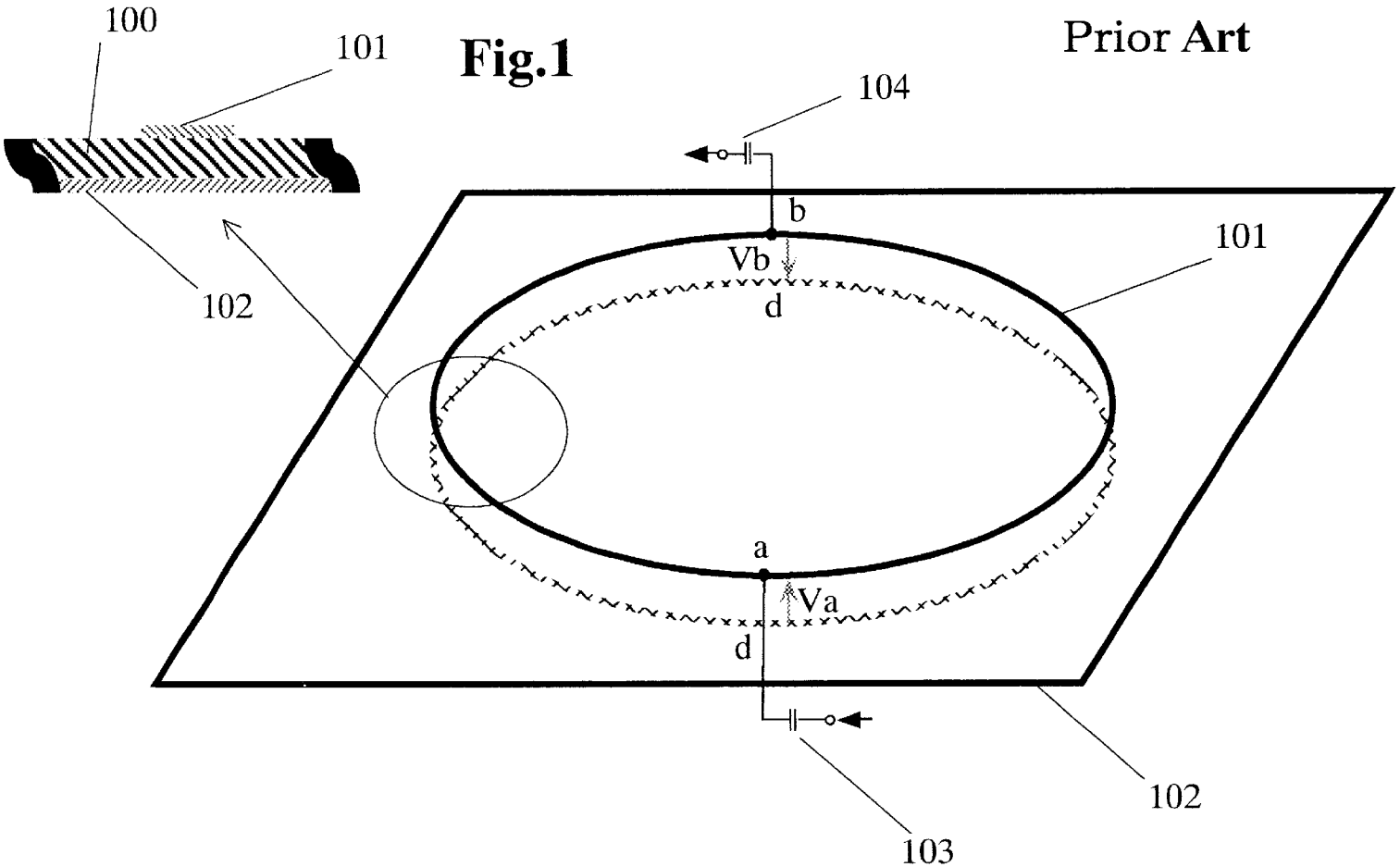
Prior Art Fig.1
FIG. 1 is a schematic view showing one example of a conventional one-wavelength ring resonator.

Next, the operation principle of the resonator of the invention is explained by comparing with the resonant operation in the conventional one-wavelength resonator shown in FIG. 1.

Figure 4:
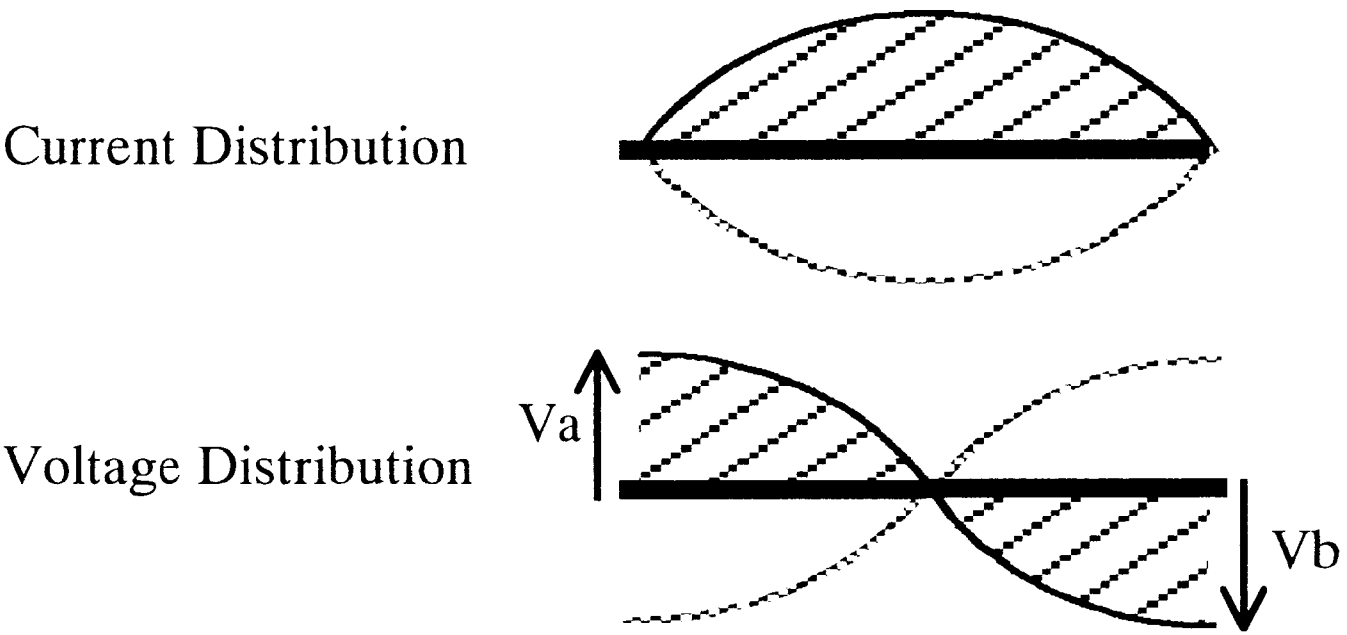
FIG. 4 is a current-and-voltage distribution diagram in a resonant state of a ring resonator according to the present invention.

FIG. 4 shows a current-and-voltage distribution in the one-wavelength resonator of FIG. 1. The potential Vb at point b on the upper conductor 101 of FIG. 1 relative to the lower conductor 102 is equal in magnitude but reverse in polarity to a potential Va at point a on the upper conductor 101 of FIG. 1 relative to the lower conductor 102. Consequently, if connection can be made opposite in polarity at point a and point b, the resonant mode can be maintained.

Figure 5:
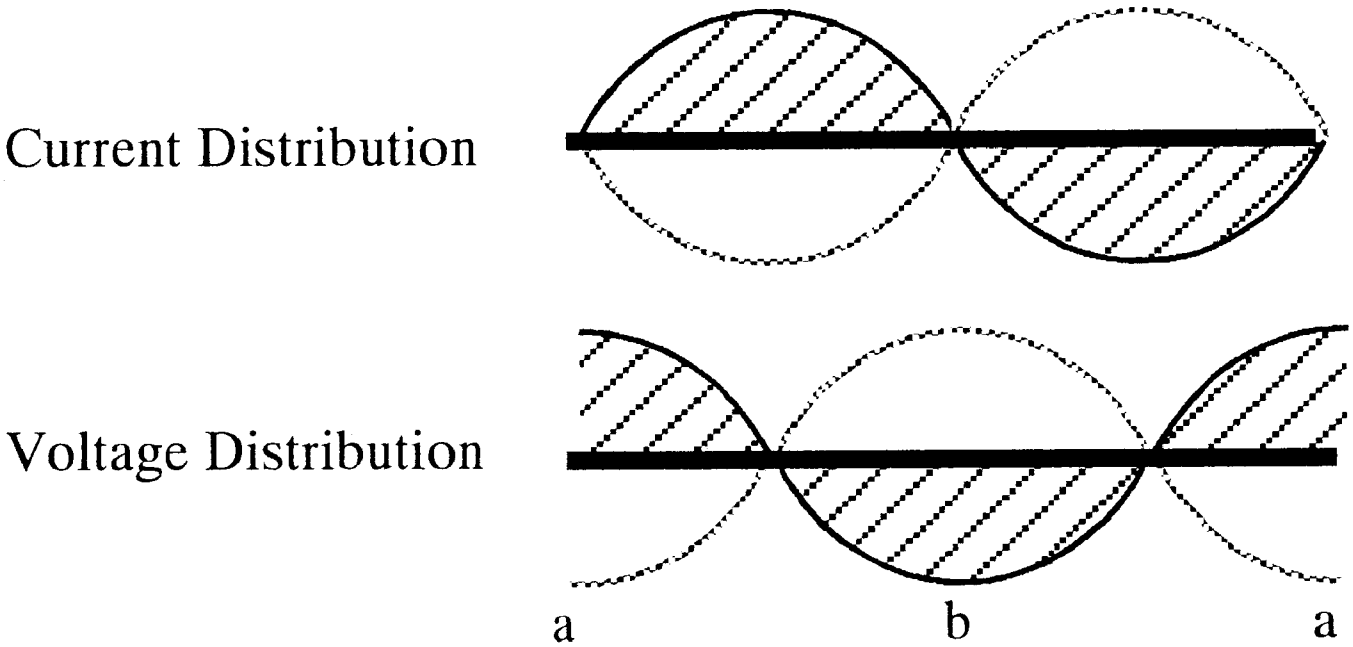
FIG. 5 is a current-and-voltage distribution diagram in a resonant state of the one-wavelength resonator of FIG. 1.

FIG. 5 is a current-and-voltage distribution in a resonant state where physical connection is made opposite in polarity at point a and point b, on the basis of the above concept. The potential Vb on the upper conductor 101 at point b of FIG. 1 is negative. However, this is the potential at point b on the upper conductor 101 relative to the lower electrode 102. Hence, the potential at point b on the lower conductor 102 of FIG. 1 can be considered positive relative to the upper conductor 101. Consequently, if connection can be made opposite in polarity at point a and point b of FIG. 1, the resonant mode is unchanged.

FIG. 3 shows a ring resonator structured according to the above concept. Namely, the transmission line of the upper conductor 101 is cut at positions corresponding to point a and point b. These are made in a ring form and arranged respectively as an upper transmission line 301 and a lower transmission line 302. Connection is made with opposite polarity between point b in the upper transmission line 301 and point c in the lower transmission line 302. Similarly, connection is made with opposite polarity between point a on the upper transmission line 301 and point d on the lower transmission line 302. Due to this, the upper transmission line 301 and the lower transmission line 302 each can be provided with half the electrical length of that of the one-wavelength resonator with resonant mode at the same frequency.

Consequently, comparing the same frequency resonators, the ring resonator in the TEM mode between a pair of lines of FIG. 3 is half the physical length of the conventional one-wavelength resonator of FIG. 1, thus making it possible to reduce the size.

Meanwhile, the resonant circuit of this embodiment is a transmission line that does not need the use of a fixed number of lumped constant elements, a factor that deteriorates Q. Consequently, it is possible to realize a resonator that is free of discontinuity and high in resonant performance.

Figure 6:
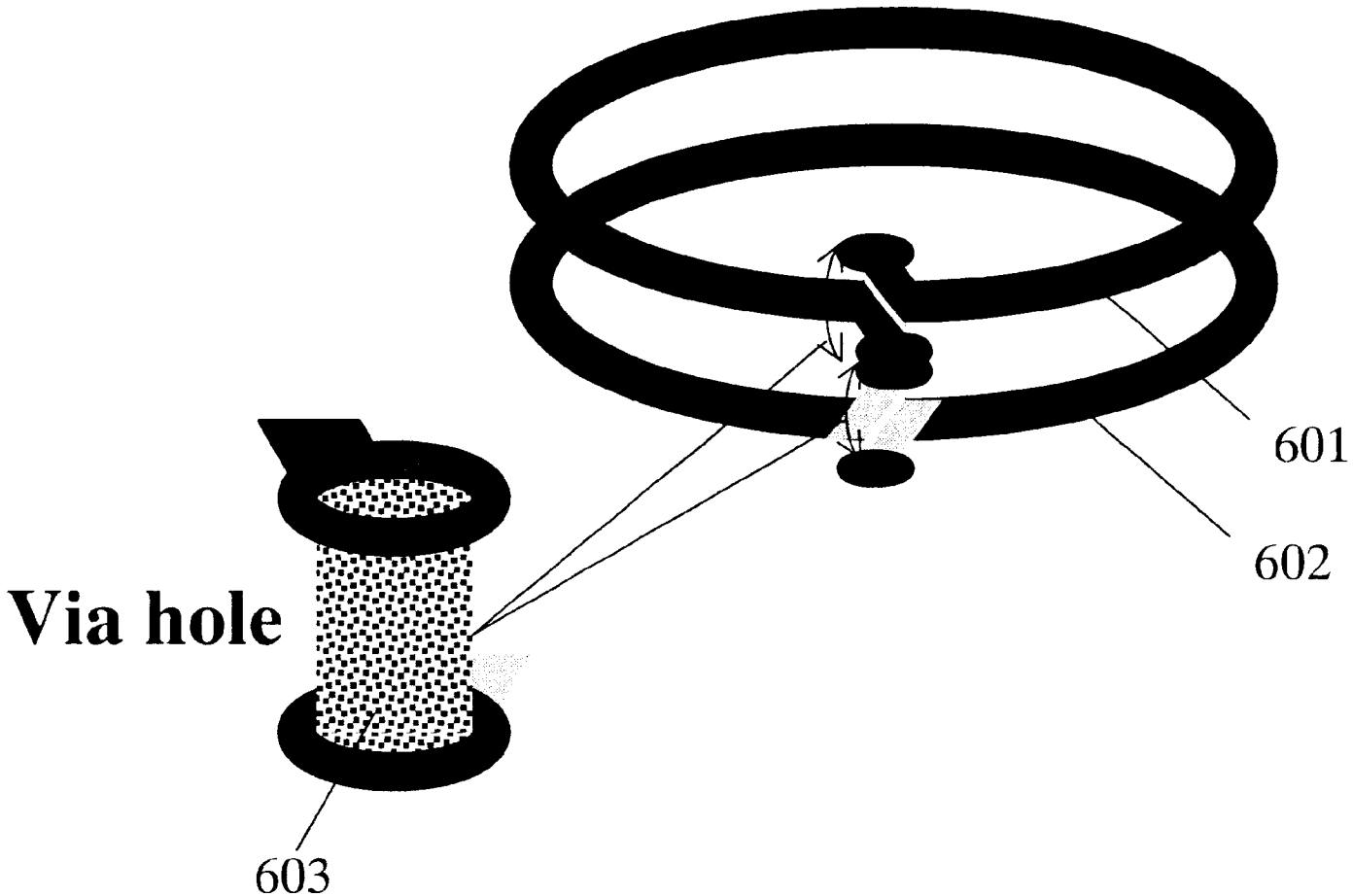
FIG. 6 is a schematic view showing the concrete structure of the upper conductor and lower conductor of FIG. 3.

FIG. 6 is a structural view showing the concrete structure of the upper transmission line 301 and lower transmission line 302 of FIG. 3. The resonator is structured with an upper metal line 601 and a lower metal line 602 formed by etching or the like on the respective surface of a dielectric substrate. The metal lines 601, 602 have ends connected through via-holes 603.

According to this embodiment, the resonator can be easily realized on a printed circuit board for use in general industrial products.

Note that, although the above explanation was on the example using a dielectric substrate for the convenience in manufacture or sustaining the circuit, such a dielectric substrate is not necessarily required, i.e. structuring is feasible with only one pair of conductor lines.

2. Second Exemplary Embodiment

Figure 7:
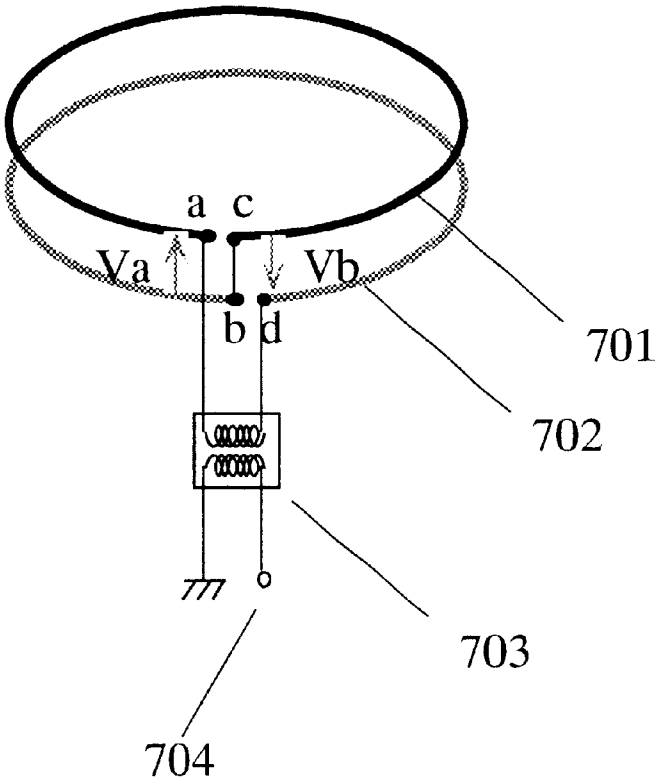
FIG. 7 is a schematic view showing a first embodiment of a ring antenna of the invention.

FIG. 7 shows a first embodiment of a ring antenna according to the invention. The upper conductor 701 and the lower conductor 702 have an electrical length corresponding to half of the wavelength for the resonant frequency and formed in a ring to constitute an antenna. Provided that the upper conductor 701 has, at opposite ends, a terminal a and a terminal c while the lower conductor 702 has, at opposite ends, a terminal b and a terminal d, connection is made between the terminal c of the upper conductor 701 and the terminal b of the lower conductor 702. Meanwhile, the terminal a of the upper conductor 701 is connected with one balanced terminal of a balun 703 while the terminal-d of the lower conductor 702 is with the other balanced terminal of the balun. The balun 703 has an unbalanced terminal 704 as a feeder terminal to the ring antenna.

Figure 2:
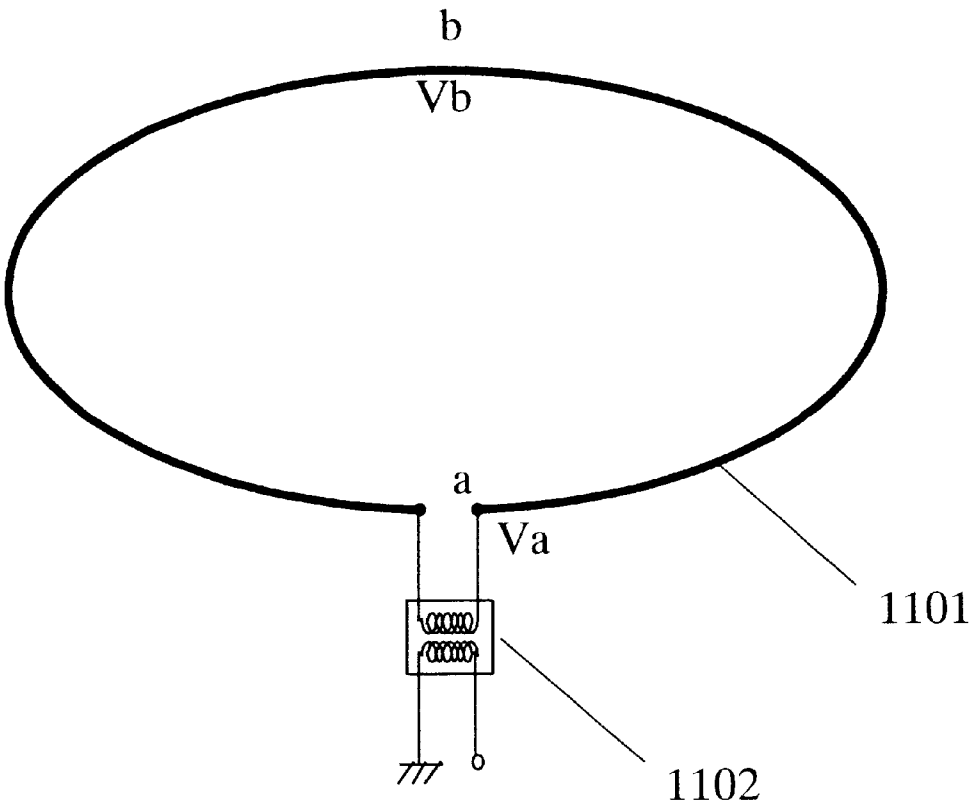
FIG. 2 is a schematic view showing one example of a conventional one-wavelength ring antenna.
Figure 8:
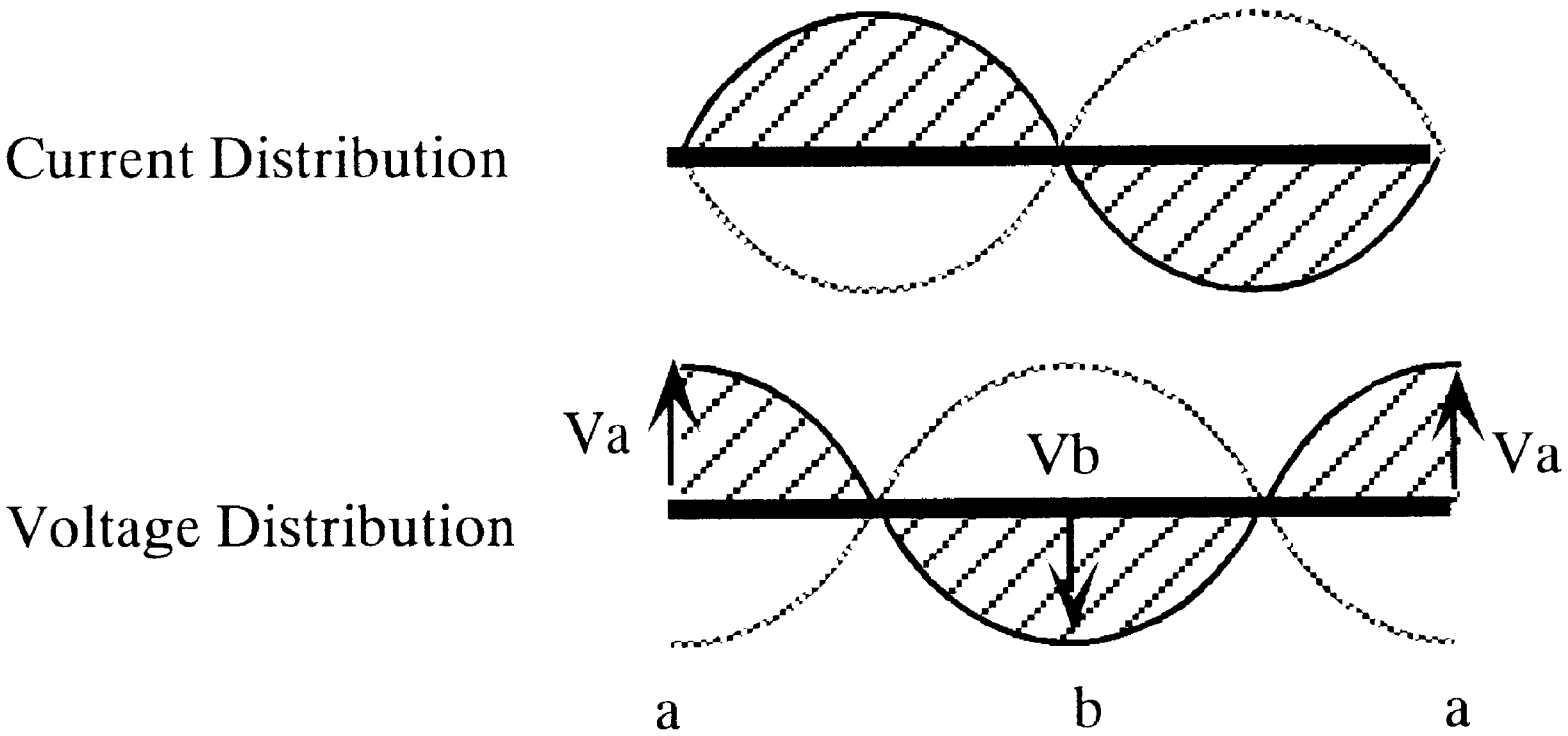
FIG. 8 is a current-and-voltage distribution diagram in a resonant mode of the ring antenna of FIG. 2.

Next, explanation is made on the operation of the ring antenna of the invention by comparing the resonant operation of the one-wavelength ring antenna of FIG. 2. In FIG. 2, the conductor 1101 forms a one-wavelength ring resonator and has a feeder balun 1102, thus constituting a ring antenna. FIG. 8 shows the current and voltage distribution in the resonant state of the one-wavelength ring antenna.

The potential Vb on the conductor at point b in FIG. 2 is inverted as compared to the potential Va at point a in FIG. 2, wherein these are the same in magnitude under ideal conditions. Consequently, even if point b of FIG. 2 is connected with opposite polarity, to point a of FIG. 2, the resonant mode exists.

Figure 9:
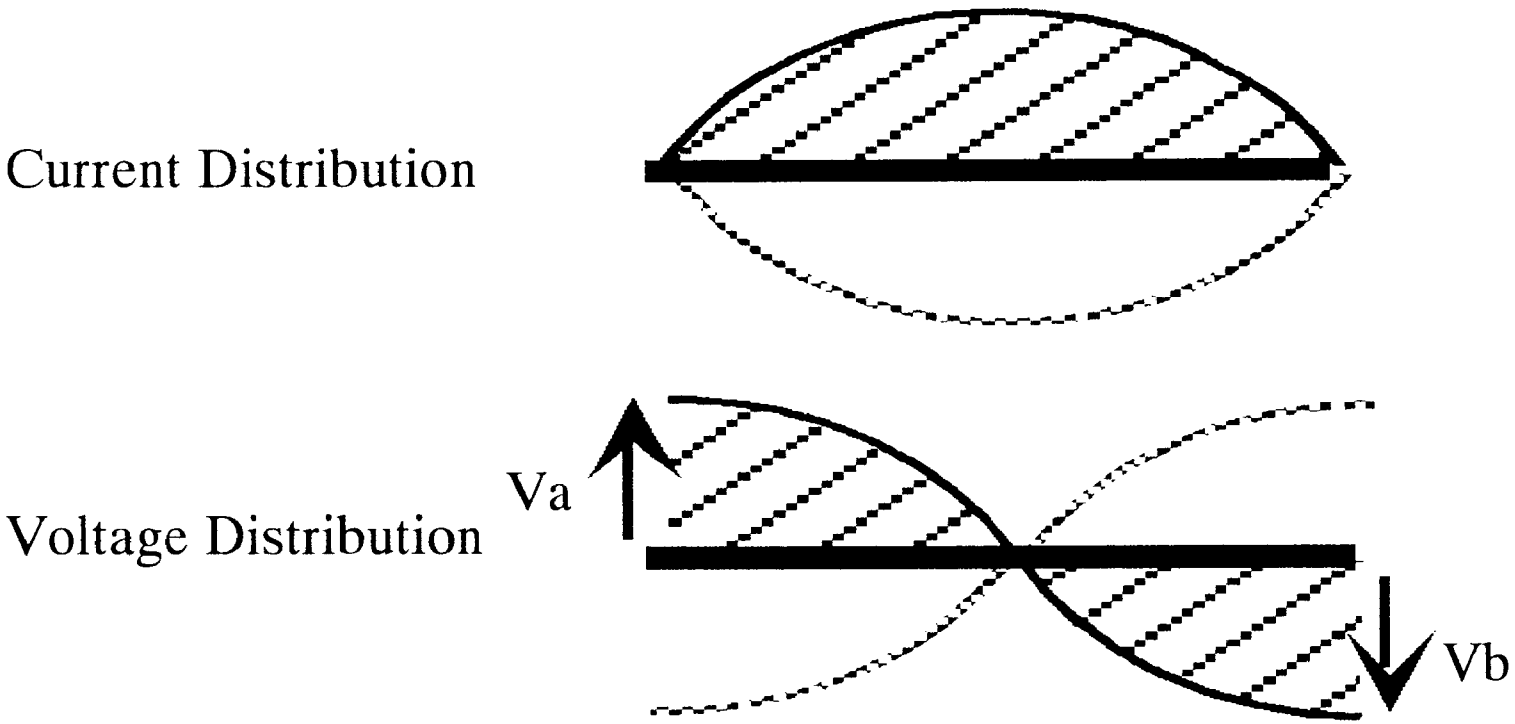
FIG. 9 is a current-and-voltage distribution diagram in a resonant mode of the ring antenna of FIG. 7.

FIG. 9 is a current-and-voltage distribution in a resonant state of the ring antenna of the embodiment of FIG. 7 on the basis of the above concept. In FIG. 7, the potential Vb at the terminal c relative to the terminal d is negative whereas the potential at the terminal-d relative to the terminal-c can be considered positive. Moreover, its magnitude is equal to the potential Va at point a. Accordingly, in FIG. 7, even if the terminal c is connected, with opposite polarity, to the terminal b and the terminal a to the terminal d, the resonant mode is not changed. For this reason, the ring antenna structure of this embodiment of FIG. 7 is half the electrical length of the one-wavelength antenna of FIG. 2 but has a resonant mode at the same resonant frequency.

In this manner, compared to the same frequency ring antenna, this embodiment is half the length of the one-wavelength ring antenna, making it possible to reduce the size. Also, the antenna circuit of this embodiment can be structured with a transmission line only. Because it does not use a fixed number of lumped constant elements, a Q-deterioration factor, there is no discontinuity in the line and thus it has efficiency equivalent to the one-wavelength ring antenna.

3. Third Exemplary Embodiment

Figure 10:
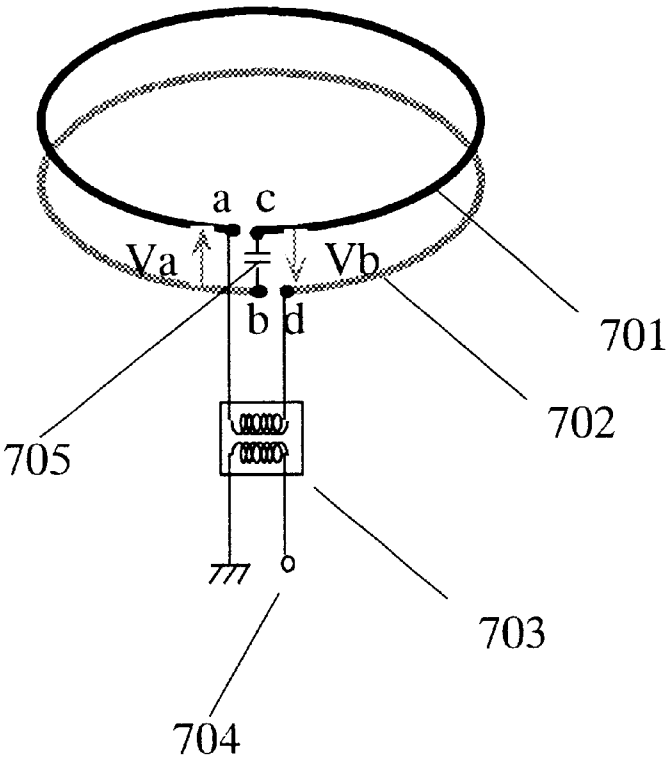
FIG. 10 is a schematic view showing a second embodiment of a ring antenna of the invention.

FIG. 10 shows a second embodiment of a ring antenna of the invention. The upper conductor 701 and the lower conductor 702 constitute a TEM transmission line. In the transmission line, end c of the upper conductor 701 and end b of the lower conductor 702 are connected through a capacitance element 705. A balun 703 for electric feed is connected between end a of the upper conductor 701 and end d of the lower conductor 702. The balun 703 has an unbalanced signal terminal 704 serving as a feeder terminal to the ring antenna.

The ring antenna of this embodiment has a lowered resonant frequency dependent upon a value of the capacitance element 705 inserted in the resonant circuit. Due to this, because the line length of antenna at the same frequency can be further shortened as compared to the structure not given a capacitance element 705, the antenna can be reduced further in size to less than half that of the conventional ring antenna.

Figure 11A:
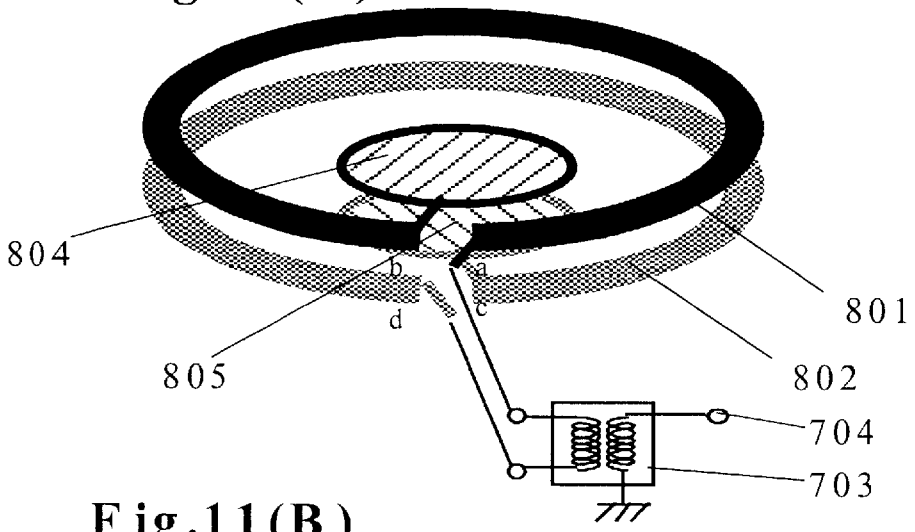
FIG. 11A is a schematic view showing the overall structure and FIGS. 11B and 11C are plan views showing other structures of the capacitance element region.

FIG. 11A is a structural view showing a detailed structure of the upper conductor 701, lower conductor 702 and capacitance element 705 of FIG. 10. The antenna is structured by an upper metal line 801 and a lower metal line 802 that are formed, by etching, on the respective surfaces of a dielectric substrate. The metal lines 801, 802 are connected together at the ends by a capacitance element structured by forming a circular extended portion 804 extended from the end of the upper metal line 801 and a circular extended portion 805 extended from the end of the lower metal line 802. A balun 703 for feed is connected between end a of the upper metal line 801 and end d of the lower metal line 802. The balun 703 has an unbalanced signal terminal 704 serving as a feeder terminal to the ring antenna of this embodiment.

Figure 11B:
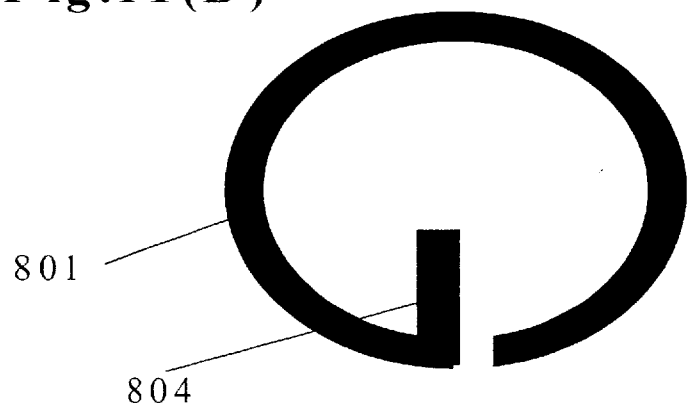
Figure 11C:
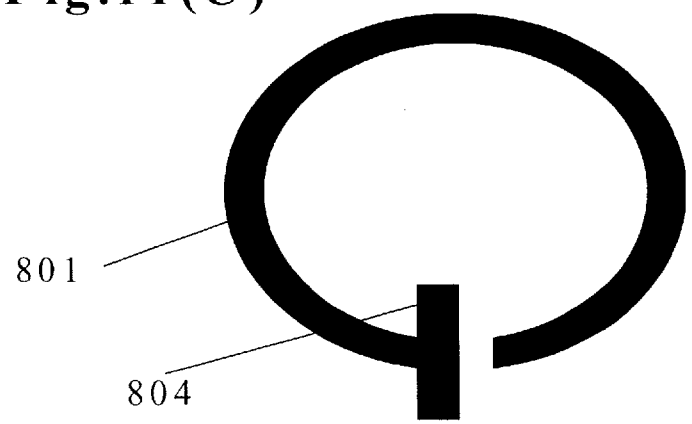

The extended portions 804, 805 of the upper metal line 801 and lower metal line 802 are not limited in shape to the circular but can be made in an arbitrary form, e.g. a rectangular form at the ends of the upper metal line 801 and lower metal line 802 pointing inward as shown in FIG. 11B or a T-form as shown in FIG. 11C.

4. Fourth Exemplary Embodiment

Figure 12:
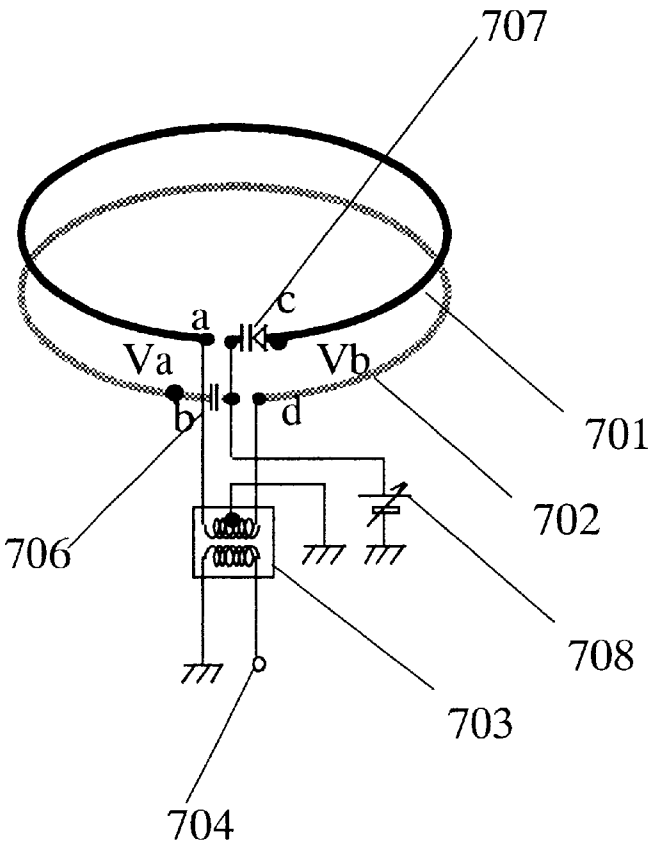
FIG. 12 is a schematic view showing a third embodiment of a ring antenna of the invention.

FIG. 12 shows a third embodiment of a ring antenna of the invention. The upper conductor 701 and the lower conductor 702 comprise a TEM transmission line. The transmission line has a connection, through a capacitance element 706 and voltage-variable capacitance element 707, between end c of the upper conductor 701 and end b of the lower conductor 702. The voltage-variable capacitance element 707, known generally as a varactor, is a capacitance element having a capacitance value controlled by the voltage at the terminal. This is inserted so that its voltage-applying terminal is connected to the capacitance element 706. A voltage source 708 for controlling the capacitance value is connected between the capacitance element 706 and the voltage-variable capacitance element 707. The capacitance-value-controlling voltage source 708, showing a variable voltage direct-current source, is connected to the voltage-applying terminal of the voltage-variable capacitance element 707 to control the capacitance value thereof.

Also, a balun 703 for feed is connected between end a of the upper conductor 701 and end d of the lower conductor 702. The balun 703 has an unbalanced signal terminal 704 serving as a feeder terminal to the ring antenna of this embodiment.

The ring antenna of this embodiment has a resonant frequency dependent upon the value of the capacitance element 706 and voltage-variable capacitance element 707 inserted in the resonant circuit. Even where the upper conductor 701 and the lower conductor 702 are the same in line length, the resonant frequency can be varied by varying the capacitance value of the voltage-variable capacitance element 706 with the capacitance-value-controlling voltage source 708. Namely, the adjustment of the ring-antenna frequency range by the capacitance-value-controlling voltage source 708 enables antenna functioning over a broader range.

5. Fifth Exemplary Embodiment

Figure 13:
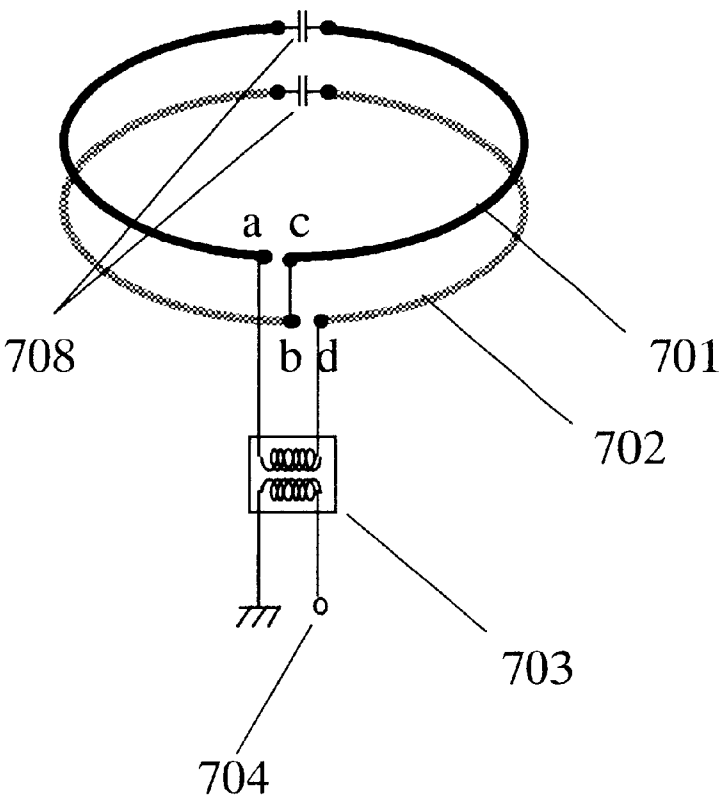
FIG. 13 is a schematic view showing a fourth embodiment of a ring antenna of the invention.

FIG. 13 shows a ring antenna of a fourth embodiment of the invention. The upper conductor 701 and the lower conductor 702 constitute a TEM transmission line. The transmission line has a connection between end c of the upper conductor 701 and end b of the lower conductor 702. Also, a balun 703 for electric feed is provided between end a of the upper conductor 701 and end d of the lower conductor 702. The balun 703 has an unbalanced signal terminal 704 serving as a feeder terminal to the ring antenna of the invention. The upper conductor 701 and the lower conductor 702 each divided at an arbitrary point into two and capacitance elements 708 are inserted in the points of division.

Figure 14B:
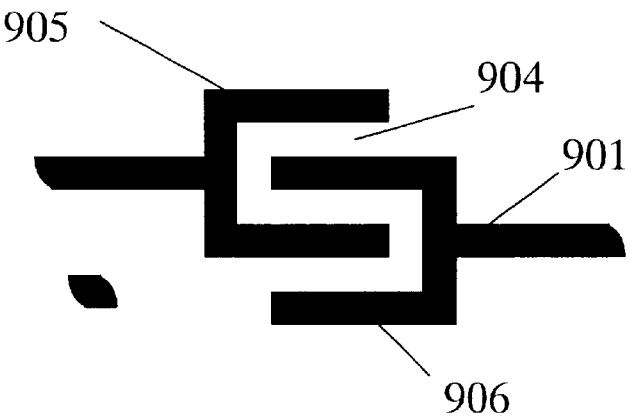
FIG. 14A is a schematic view showing the overall structure and FIG. 14B is a plan view showing other structure of the capacitance element region.
Figure 14A:
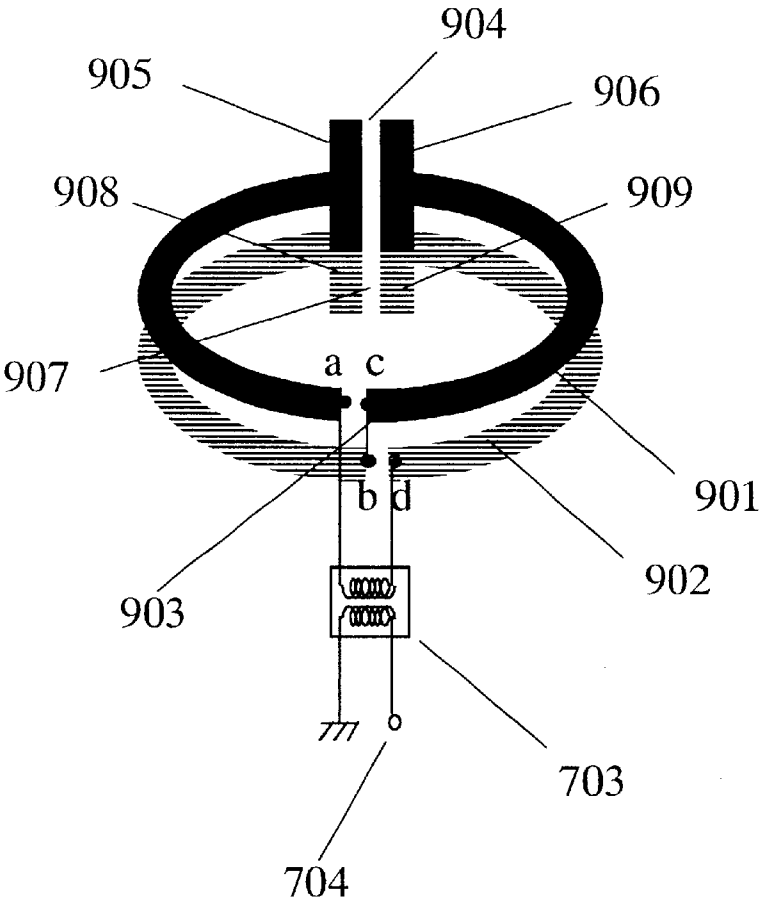

FIG. 14 is a structural view showing a concrete structure of the upper conductor 701, lower conductor 702 and capacitance element 708 of FIG. 13. The antenna is structured by an upper metal line 901 and a lower metal line 902 that are formed by etching or the like on the opposite surfaces of a dielectric substrate. Connection is made through a via-hole 903 between end c of the upper metal line 901 and end b of the lower metal line 902. The capacitance element 708 comprises a gap 904 formed by splitting an intermediate portion of the upper metal line 901 and a gap 907 formed by splitting an intermediate portion of the lower metal line 902. A pair of T-shape patterns 905, 906 are formed for the gap 904 as required. Similarly, a pair of T-shape patterns 908, 909 are formed for the gap 907. The balun 703 is connected between end a of the upper metal line 901 and end d of the lower metal line 902. The unbalanced signal terminal 704 of the balun 703 provides a feeder terminal to the ring antenna of this embodiment.

Note that it is satisfactory to form, for the gap 904, 907, patterns in other forms than the T-shape pattern, e.g. in the form shown in FIG. 14B or FIG. 11B.

Although the above explanation showed the examples with the capacitance element configured by a distributed constant circuit, it is apparent that the configuration is possible with lumped constant elements.

The ring antenna of the embodiment has a resonant frequency lowered depending upon a value of the capacitance element 608 inserted in the resonant circuit. This makes it possible to reduce the size of antenna at the same frequency as compared to the configuration not given a capacitance element 608. Also, because the capacitance element can be inserted at an arbitrary point in the ring antenna device, there are fewer restrictions in how the circuit can be mounted to the main device.

Although the embodiments were explained on the examples the transmission lines constituting a resonator were formed by metal lines on the opposite surfaces of the dielectric plate, it is apparent that the invention is similarly applicable to other TEM mode transmission lines including a lecher-wire model.

What is claimed is:

1. A ring resonator comprising:

a first TEM transmission line formed on a first side of a dielectric substrate; and a second TEM transmission line formed on a second side of said dielectric substrate opposite said first transmission line, a first end of said first transmission line, having opposite polarity of, and being coupled to, a second end of said second transmission line, and a second end of said first transmission line, having opposite polarity of, and being coupled to, a first end of said second transmission line.

2. A ring resonator according to claim 1, further comprising a first coupling capacitor connected at an intermediate point between the first end of the first transmission line and the second end of the second transmission line to supply an input signal, and a second coupling capacitor connected at an intermediate point between the second end of the first transmission line and the first end of the second transmission line to extract an output signal.

3. A ring resonator according to claim 1, wherein the substrate is a dielectric substrate, the dielectric substrate having a first metal line formed in one surface thereof and a second metal line formed in the other surface to structure a first transmission line and a second transmission line, the first and second metal lines being connected together by a via-hole.

4. A ring resonator according to claim 1, wherein the substrate is a dielectric substrate, the dielectric substrate having a first metal line formed in one surface thereof and a second metal line formed in the other surface to structure a first transmission line and a second transmission line, the first and the second metal lines being formed respectively with extended portions at both ends thereof to form capacitance elements.

5. A ring antenna comprising:

a ring shaped TEM transmission line arranged on a dielectric substrate, said ring shaped TEM transmission line including, a first transmission line having a terminal a and a terminal c;

a second transmission line having a terminal b and a terminal d; and a balun having a first balanced terminal and a second balanced terminal, said terminal b being coupled to said terminal c, said first balanced terminal being coupled to said terminal a, said second balanced terminal being coupled to said terminal d, and an unbalanced terminal of said balun being provided as a feeder terminal to said ring antenna.

6. A ring antenna according to claim 5, further comprising a capacitance element connected between the terminal c and the terminal b.

7. A ring antenna according to claim 5, further comprising a capacitance element and a voltage-variable capacitance element that are connected between the terminal c and the terminal b, the voltage-variable capacitance element control voltage input lead being connected to said capacitance element, a control voltage source being connected at an intermediate point between the capacitance element and the voltage-variable capacitance element.

8. A ring antenna according to claim 5, wherein the first and second transmission lines are each divided into two, and respective divided ends are connected through capacitance elements.

9. A ring antenna according to claim 5, wherein the first and second transmission lines are structured by first and second metal lines formed in opposite surfaces of a dielectric substrate, the connection of the terminal c and the terminal b is made by connecting ends of the first and second metal lines through a via-hole.

10. A ring antenna according to claim 5, wherein the first and second transmission lines are structured by first and second metal lines formed in opposite surfaces of a dielectric substrate, the terminal c and the terminal b respectively having extended portions to form a capacitance element.

11. A ring antenna according to claim 5, wherein the first and second transmission lines are structured by first and second metal lines formed in opposite surfaces of a dielectric substrate, the first and second transmission lines are each divided into two, the gaps thereby created forming capacitance elements.

12. A ring antenna comprising:

a ring shaped TEM transmission line arranged on a dielectric substrate, said ring shaped TEM transmission line including a first transmission line and a second transmission line, a first end of said first transmission line, having opposite polarity of, and being coupled to, a second end of said second transmission line, and a second end of said first transmission line, having opposite polarity of, and being coupled to, a first end of said second transmission line.

* * * * *